United States Patent [19]

Scholl

[11] Patent Number: 4,945,817

[45] Date of Patent: Aug. 7, 1990

[54] AXIAL PISTON DEVICE

[75] Inventor: Kenneth L. Scholl, Lockport, N.Y.

[73] Assignee: General Motors Corporation, Detroit, Mich.

[21] Appl. No.: 426,622

[22] Filed: Oct. 24, 1989

[51] Int. Cl.[5] ..... F04B 1/26; F16H 23/00

[52] U.S. Cl. ..... 91/505; 417/222

[58] Field of Search ..... 91/505, 506, 507; 417/222; 92/71

[56] References Cited

U.S. PATENT DOCUMENTS

| | | | |
|---|---|---|---|
| Re. 26,519 | 1/1969 | D'Amato | 91/505 |
| 2,272,771 | 2/1942 | Hawley, Jr. | 91/505 |
| 3,256,830 | 6/1966 | Budzich | 417/222 |
| 3,422,767 | 1/1969 | McAlvay | 91/505 |
| 3,800,673 | 4/1974 | Lutz et al. | 91/487 |
| 4,289,452 | 9/1981 | Kubilos | 417/222 |
| 4,581,980 | 4/1986 | Berthold | 92/12.2 |
| 4,855,480 | 8/1989 | Rohde et al. | 91/505 |

*Primary Examiner*—Leonard E. Smith
*Assistant Examiner*—R. Blackmon
*Attorney, Agent, or Firm*—Saul Schwartz

[57] ABSTRACT

A variable displacement axial piston device wherein the tilt-yoke trunnion bearings include an inner race on each trunnion, bearings, and a rectangular retainer having a cylindrical inner wall defining the outer race for the bearings and a rectangular outer wall which is received in a correspondingly rectangular socket in the mounting flange of the housing of the device. The sockets have one open side for insertion of the retainers as a unit with the tilt-yoke and the open side is closed by a retainer portion of the valve block of the housing of the device when the valve block is bolted to the mounting flange.

4 Claims, 3 Drawing Sheets

AXIAL PISTON DEVICE

FIELD OF THE INVENTION

This invention relates to variable displacement axial piston fluid devices such as pumps and motors.

BACKGROUND OF THE INVENTION

Typical variable displacement axial piston devices, e.g. pumps and motors, have a housing, a rotatable drive shaft on the housing, a cylinder barrel on the drive shaft with a plurality of axial pistons in bores in the barrel, and a tilt-yoke which changes the displacement of the axial pistons. The housing is a two-piece assembly including a first half called a mounting flange and a second half called a valve block. The mounting flange carries a first or primary bearing for the drive shaft and the valve block carries a second or secondary bearing for the drive shaft. An annular plate of the tilt-yoke surrounds the drive shaft near the primary bearing. A pair of diametrically opposite trunnions extend from the plate and are supported on the mounting flange by trunnion bearings in trunnion bearing sockets in the mounting flange.

In assembling such common or typical devices, the trunnion bearings are necessarily assembled after the drive shaft and primary bearing are fully assembled on the mounting flange. Then, the trunnion bearings are assembled by sliding each end-wise over a corresponding trunnion and into its sockets. The trunnion bearings are prevented from backing out of the sockets by portions of the valve block which envelop the trunnion bearing sockets. This procedure is not attractive for high volume applications because it is relatively difficult, and therefore time consuming, for an assembler to center the trunnions in the trunnion bearing sockets against various spring forces reacting on the tilt-yoke. The axial piston device according to this invention incorporates novel structure which simplifies the above assembly steps and, further, which facilitates relative alignment between the primary and secondary bearings.

SUMMARY OF THE INVENTION

This invention is a new and improved variable displacement axial piston device including a two-piece housing, a drive shaft rotatably supported on the housing, a cylinder barrel on the drive shaft having a plurality of axial pistons in bores in the barrel, and a tilt-yoke on the housing to vary the displacement of axial pistons. In the axial piston device according to this invention, the two-piece housing includes a mounting flange having an inside pilot adjacent an annular end thereof and a valve block having a corresponding outside pilot adjacent an annular end thereof which cooperates with the inside pilot on the mounting flange in aligning the primary and secondary bearings on a drive shaft axis of the housing. The alignment accuracy afforded by the pilots contributes to maximizing the durability of the primary and secondary bearings. The tilt-yoke trunnion bearings include inner races pressed on the trunnions, bearings on the inner races, and retainers having cylindrical inner surfaces defining outer races for the bearings and non-cylindrical outer walls. The trunnion bearings are assembled on the tilt-yoke trunnions and the drive shaft and tilt-yoke are together assembled on the mounting flange, the trunnion bearing retainers being received through open sides of non-cylindrical sockets on the mounting flange. When the valve block is thereafter bolted to the mounting flange, a flat side of the valve block closes the open sides of the trunnion bearing sockets.

DESCRIPTION OF PREFERRED EMBODIMENT

Figure 1:
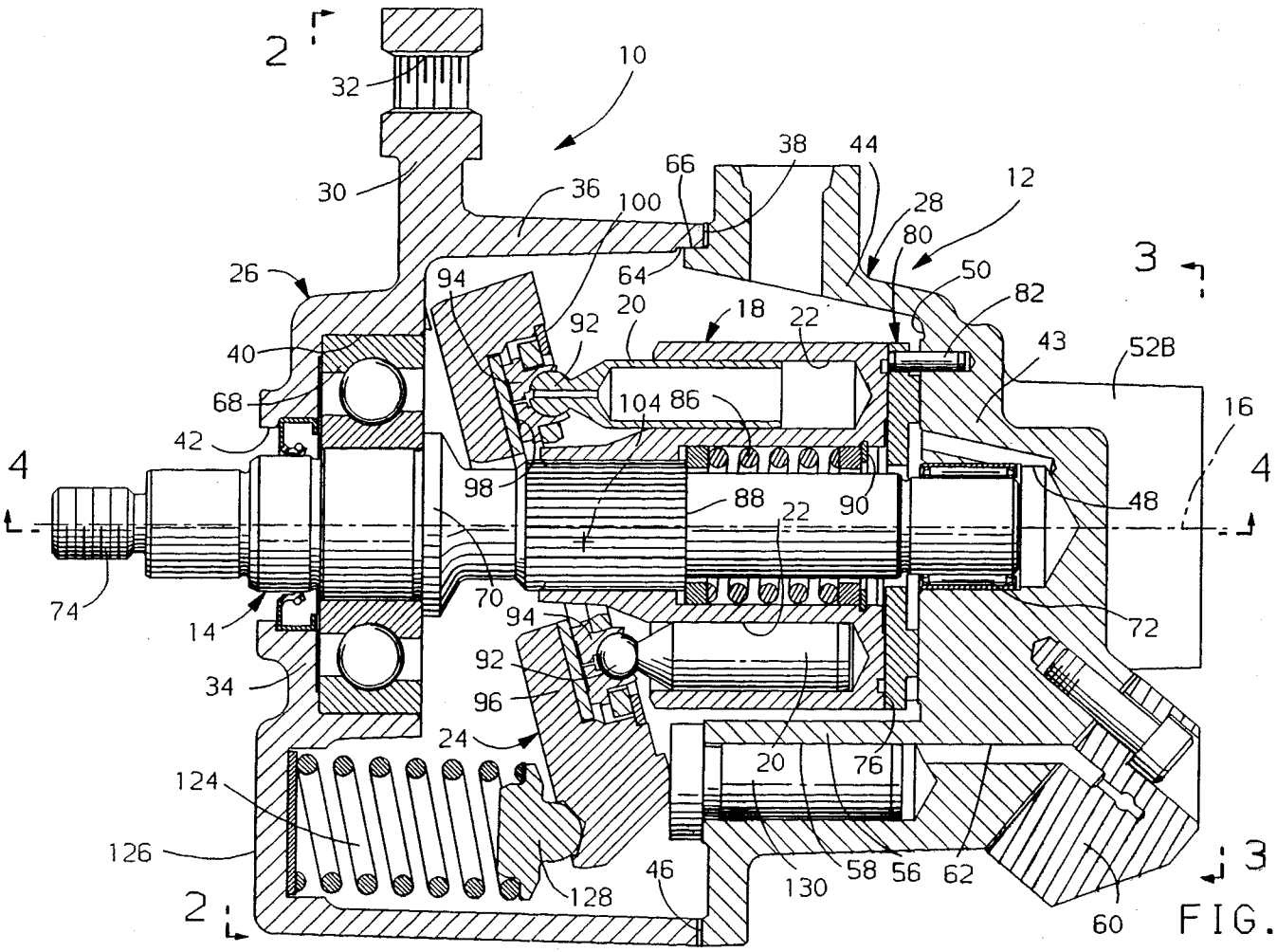
FIG. 1 is a longitudinal sectional view of a variable displacement axial piston fluid device according to this invention.

Referring to FIGS. 1—4, a generic variable displacement axial piston device 10 according to this invention includes a two-piece housing 12, a drive shaft 14 on a drive shaft axis 16 of the housing, a cylinder barrel 18 having a plurality of axial pistons 20 in a corresponding plurality of bores 22 in the barrel, and a tilt-yoke 24. The housing 12 includes a cup-shaped mounting flange 26 and a similarly cup-shaped valve block 28.

Figure 2:
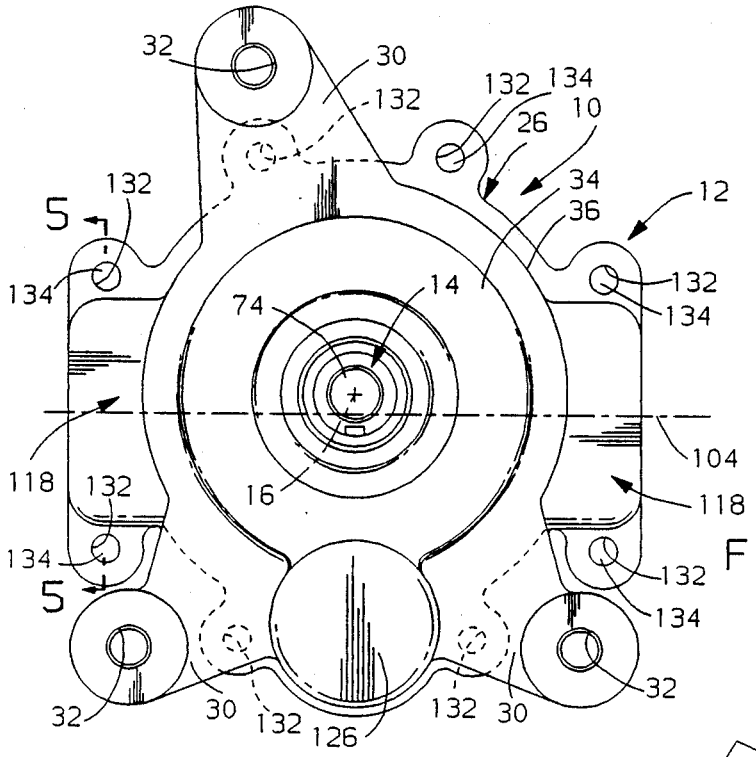
FIG. 2 is a view taken generally along the plane indicated by lines 2—2 in FIG. 1.
Figure 3:
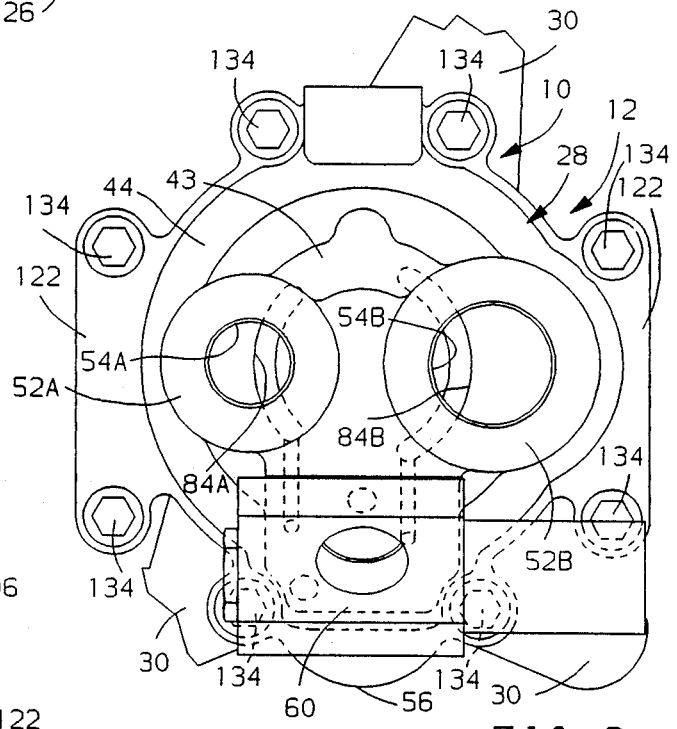
FIG. 3 is a view taken generally along the plane indicated by lines 3—3 in FIG. 1.

As seen best in FIGS. 1–2, the mounting flange 26 has a plurality of reinforced lugs 30 each having a threaded hole 32 therein for attachment of the axial piston device 10 to a supporting structure, not shown. The mounting flange further includes a circular base 34 and a cylindrical wall 36 which terminates in an interrupted annular end 38, FIG. 1. A cylindrical counterbore 40 on an inside surface of the circular base 34 surrounds a hole 42 through the circular base aligned on the drive shaft axis 16.

The valve block 28 has a circular base 43, FIG. 1, and a cylindrical wall 44 which terminates at an annular end 46. The annular end 38 abuts the annular end 46 when the mounting flange 26 and the valve block 28, respectively, are bolted together. The circular base 43 of the valve block has a bore 48 in an inside surface 50 thereof, FIGS. 1 and 4, aligned on the drive shaft axis 16 and pair of outside bosses 52A-B. The boss 52A has a threaded bore 54A therein, FIGS. 3–4, defining a high pressure port. The boss 52B has a threaded bore 54B therein defining a low pressure port. An internal boss 56 of the valve block has an actuator piston bore 58 therein parallel to the drive shaft axis 16. A conventional compensator valve 60 is bolted to the valve block 28 and connected to the actuator piston bore 58 by a passage 62, FIG. 1.

The mounting flange 26 has a cylindrical inside pilot 64 adjacent the annular end 38. The valve block 28 has a corresponding cylindrical outside pilot 66 adjacent the annular end 46. The outside pilot 66 is closely received in the inside pilot 64 when the mounting flange and the valve block are bolted together to closely align the counterbore 40 and the bore 48 on the drive shaft axis 16 of the housing.

Figure 4:
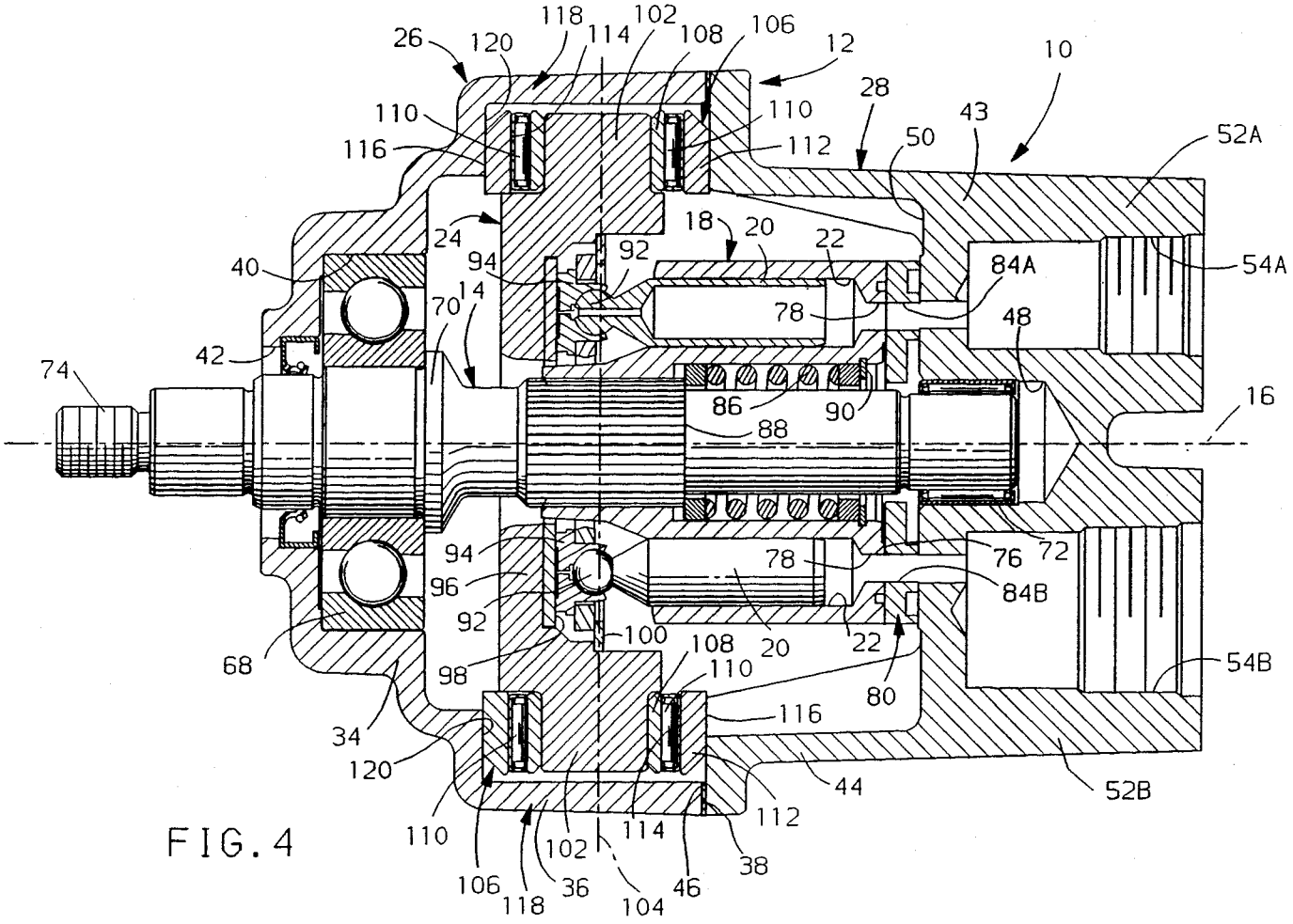
FIG. 4 is a sectional view taken generally along the plane indicated by lines 4—4 in FIG. 1.

As seen best in FIGS. 1 and 4, a primary roller bearing 68 is pressed on the drive shaft 14 against an annular shoulder 70 on latter. The primary bearing seats in the counterbore 40 in the circular base 34 and cooperates with a secondary needle bearing 72 in the bore 48 in the circular base 43 in supporting the drive shaft 14 on the housing 12 for rotation about the drive shaft axis 16. A threaded end 74 of the drive shaft projects beyond the circular base 34 of the mounting flange 26 for attachment of a pulley or like element.

The cylinder barrel 18 is spline connected to the drive shaft 14 for rotation as a unit with the latter and for limited relative axial movement. The bores 22 communicate with an inboard end 76 of the barrel, FIGS. 1 and 4, through respective ones of a plurality of passages 78. A circular valve plate 80 is disposed between the inboard end 76 of the barrel and the inside surface 50 of the circular base 43 of the valve block and held stationary by a dowel 82, FIG. 1. The valve plate has an arcuate high pressure slot 84A connected to the high pressure port 54A and an arcuate low pressure slot 84B connected to the low pressure port 54B, FIGS. 3–4. A spring 86 around the drive shaft 14 seats against a shoulder 88 on the shaft 14 and against a retaining ring 90 on the cylinder barrel to bias the barrel and the valve plate against the inside surface 50.

Each of the pistons 20 on the cylinder barrel 18 projects out of its bore 22 and has a bulb-shaped connector 92 at its left end. Respective ones of a plurality of bearing shoes 94 are universally articulated to corresponding ones of the pistons 20 at the connectors 92.

Figure 5:
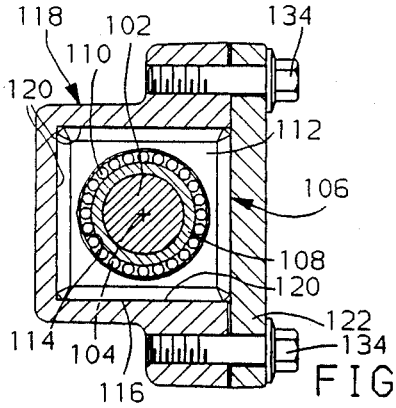
FIG. 5 is a sectional view taken generally along the plane indicated by lines 5—5 in FIG. 2.

The tilt-yoke 24 includes an annular plate 96 surrounding the drive shaft 14 near the primary bearing 68, FIGS. 1 and 4. The plate 96 has a bearing surface 98 on which the shoes 94 slide. The shoes are loosely retained against the bearing surface 98 by a retainer 100 on the plate 96. The tilt-yoke further includes a pair of integral cylindrical trunnions 102, FIGS. 4–5, projecting radially out and located diametrically opposite each other on a transverse axis 104 of the housing 12.

The trunnions 102 are supported on the housing 12 for pivotal movement about the transverse axis 104 by a pair of trunnion bearings 106. Each bearing includes a cylindrical inner race 108 rigidly attached to the corresponding one of the trunnions 102, a plurality of bearings 110 and a substantially rectangular retainer 112. Each retainer 112 has a cylindrical inner surface 114 defining an outer race for the bearings 110 and a four-sided, non-cylindrical outer wall 116.

The retainers 112 seat in respective ones of a pair of sockets 118 in the mounting flange 26. Each of the sockets has a three-sided inner wall 120 which matches three of the four sides of the outer wall 116 of the corresponding retainer 112. The sockets 118 are open toward the annular end 38 of the mounting flange and toward the interior of the housing 12. Respective ones of a pair of generally flat retainer portions 122 of the valve block 28, FIGS. 3 and 5, close the open sides of the sockets at the annular end 38 to capture the retainers 112 in the sockets 118. Clearances of up to about 0.007 inch between the retainers and the sockets allow the retainers to float within the sockets.

As seen best in FIGS. 1–2, a spring 124 in a hollow boss 126 of the mounting flange 26 seats against the latter and carries an actuator 128 which bears against the annular plate 96 of the tilt-yoke. The spring biases the tilt-yoke counterclockwise about the axis 104 to a maximum stroke position, FIG. 1. An actuator piston 130 in the actuator piston bore 58 in the valve block bears against the annular plate 96 opposite the spring 124 and, when the bore is pressurized, rotates the tilt-yoke clockwise about the axis 104 to reduce the stroke of the axial pistons 20 in well known fashion.

The trunnion bearings 106 and the pilots 64–66 are related and important features of this invention and contribute to accurate yet simplified assembly of the device 10. For example, the primary bearing 68 and the cylinder barrel 18 with pistons 20 thereon are assembled on the drive shaft 14 with the annular plate 96 of the tilt-yoke loosely received around the drive shaft near the primary bearing. The inner races 108 of the trunnion bearings 106 are mounted on the trunnions 102 followed by the bearings 110 and the retainers 112.

The threaded end 74 of the drive shaft 14 is guided through the hole 42 and the primary bearing 68 and the retainers 112 are guided into the counterbore 40 and the sockets 118, respectively. The actuator 128 on the end of spring 124 engages the annular plate 96 of the tilt-yoke during insertion of the drive shaft 14 and pivots the tilt-yoke toward its maximum stroke position. The valve block 28 is then positioned over right end of the drive shaft and assembled by concurrently guiding the right end of the drive shaft into the needle bearings 72 in the bore 48 and the outside pilot 66 into the inside pilot 64. Assembly proceeds without compression of either of the springs 86,124 until the valve plate 80 just contacts the inboard end 76 of the cylinder barrel 18. At that point in the assembly, the annular ends 38,46 on the mounting flange 26 and the valve block 28, respectively, are within about 0.06 inch of each other.

The mounting flange and the valve block are angularly indexed about the drive shaft axis 16 to achieve registry between a plurality of bolt holes 132, FIG. 2, on the two shells. A corresponding plurality of connecting bolts 134 are inserted through the registered holes and tightened to bring the annular ends 38,46 into abutting relationship. A gasket, not shown, may be positioned between the annular ends. As the bolts are tightened, the inside and outside pilots 64,66 maintain alignment of the counterbore 40 and bore 48 relative to the drive shaft axis 16. The float or clearance between the retainers 112 of the trunnion bearings and the sockets 118 accommodates small positional adjustment of the tilt-yoke relative to the housing. During the terminal increments of movement of the mounting flange and valve block toward each other, the springs 86,124 are easily compressed as the bolts 134 are tightened.

The embodiments of the invention in which an exclusive property or privilege is claimed are defined as follows:

1. In a variable displacement axial piston device including a cup-shaped mounting flange having an annular end, a cup-shaped valve block having an annular end, said valve block and said mounting flange abutting at said annular ends thereof to define a housing of said axial piston device, a drive shaft having a cylinder barrel thereon with a plurality of axial bores in said cylinder barrel and a corresponding plurality of pistons slidably disposed in respective ones of said axial bores, a primary bearing means supporting a first end of said drive shaft on said mounting flange for rotation about a drive shaft axis of said housing, a secondary bearing means supporting a second end of said drive shaft on said valve block for rotation about said drive shaft axis, and a tilt-yoke in said housing having an annular plate around said drive shaft engageable by said pistons and a pair of diametrically opposite trunnions extending radially out from said annular plate, the improvement comprising:

a pair of bearing inner races each rigidly attached to a respective one of said trunnions, a pair of retainers each having a cylindrical inner surface surrounding and radially spaced from respective ones of said pair of bearing inner races and a non-cylindrical outer wall, a plurality of anti-friction bearings between each of said inner races and the surrounding one of said cylindrical surfaces, means on said mounting flange defining a pair of sockets each including an open end adjacent said annular end of said mounting flange for reception of a respective one of said retainers and a non-cylindrical inner wall portion matching said non-cylindrical outer wall of said respective one of said retainers, and means on said valve block defining a pair of retainers closing respective ones of open ends of said sockets when said mounting flange and said valve block abut at said annular ends thereof.

2. The variable displacement axial piston device recited in claim 1 wherein predetermined clearance is provided between said non-cylindrical outer walls of said retainers and said non-cylindrical inner walls of said respective sockets so that said retainers float in said respective sockets.

3. The variable displacement axial piston device recited in claim 2 and further including means on said mounting flange defining a cylindrical inside pilot adjacent said annular end thereof centered on said drive shaft axis, and means on said valve block defining a cylindrical outside pilot adjacent said annular end thereof centered on said drive shaft axis, said inside and said outside pilots being closely engaged when said mounting flange and said valve block abut at said annular ends thereof.

4. The variable displacement axial piston device recited in claim 3 wherein said non-cylindrical outer wall of each of said retainers defines a rectangle, and said non-cylindrical inner wall of each of said sockets defines three sides of a rectangle.

* * * * *